US010030889B2

(12) United States Patent
Merritt

(10) Patent No.: US 10,030,889 B2
(45) Date of Patent: Jul. 24, 2018

(54) PATIO HEATER BASE AND POLE ASSEMBLY

(71) Applicant: Superior Radiant Products LTD., Stoney Creek (CA)

(72) Inventor: Andrew Merritt, Grimsby (CA)

(73) Assignee: Superior Radiant Products

( * ) Notice: Subject to any disclaimer, the term of this patent is extended or adjusted under 35 U.S.C. 154(b) by 337 days.

(21) Appl. No.: 14/933,157

(22) Filed: Nov. 5, 2015

(65) Prior Publication Data

US 2016/0138828 A1 May 19, 2016

Related U.S. Application Data

(60) Provisional application No. 62/080,438, filed on Nov. 17, 2014.

(51) Int. Cl.

| | |
|---|---|
| ***F24B 1/02*** | (2006.01) |
| ***F24H 9/02*** | (2006.01) |
| ***F24H 9/06*** | (2006.01) |
| ***F24C 1/12*** | (2006.01) |
| ***F24C 1/16*** | (2006.01) |

(52) U.S. Cl.

CPC ..... *F24H 9/02* (2013.01); *F24C 1/12* (2013.01); *F24C 1/16* (2013.01); *F24H 9/06* (2013.01)

(58) Field of Classification Search

USPC ..... 126/72; 392/407

See application file for complete search history.

(56) References Cited

U.S. PATENT DOCUMENTS 5,011,319 A * 4/1991 Levi ..... F16B 7/1427 403/109.5

8,068,726 B2 * 11/2011 Saunders ..... F24C 3/04 392/407

* cited by examiner

*Primary Examiner* — Avinash Savani

(74) *Attorney, Agent, or Firm* — Ridout & Maybee LLP

(57) ABSTRACT

The present concept is a patio heater assembly. The patio heater assembly includes a base and at least one support platform spaced from the base that is supported and attached to a vertically extending rear upright and at least one vertically extending forward upright. The uprights are attached at one end to the base and the other end to the at least one support platform. There is a pole moveable between a collapsed position and a raised assembled position that includes at least one pole flange at a bottom end of the pole. The pole flange rigidly connects to the support platform when in the raised assembled position, thereby maintaining the patio heater assembly in the raised assembled position. While in the collapsed position the pole flange rests on the base.

14 Claims, 3 Drawing Sheets

100
119

120
128
121
118
2
2
117
116
126
114
112
112
105
104
102
110
106
108

130
114
112

122
124
112

PATIO HEATER BASE AND POLE ASSEMBLY

This application claims priority from the previously filed provisional application No. 62/080,438, filed on Nov. 17, 2014 by Superior Radiant Products Ltd. under the title: PATIO HEATER BASE AND POLE ASSEMBLY.

FIELD OF THE INVENTION

The present concept relates to patio heaters and more particularly relates to the construction and structure of the base and pole assembly.

SUMMARY OF THE INVENTION

The present concept is a patio heater assembly comprising:

a) a base and at least one support platform spaced from the base and supported and attached to a vertically extending rear upright and at least one vertically extending forward upright, the uprights attached at one end to the base and the other end to the at least one support platform;

b) a pole moveable between a collapsed position and a raised assembled position, c) the pole includes at least one pole flange at a bottom end of the pole, the pole flange for rigidly connecting to the support platform when in the raised assembled position, thereby maintaining the patio heater assembly in the raised assembled position, wherein in the collapsed position the pole flange rests on the base.

Preferably that further includes a shroud slide-ably engaging over the uprights and slide ably moveable between an upper supported position above the base and a lower seated position.

Preferably wherein the shroud includes a guide bracket for slide-ably engaging along the rear upright when the shroud is moved between a lower seated position and the upper supported position.

Preferably wherein the guide bracket is a U shaped bracket such that the rear upright nests within the U of the guide bracket.

Preferably wherein the rear upright is a U shaped channel dimensioned to nest with the U shaped bracket.

Preferably wherein the shroud is cylindrical having a cylindrical side wall and a horizontal top cover such that in the lower seated position the shroud rests on the base and conceals the at least one support platform.

Preferably wherein in the upper supported position the shroud is resting on pins resiliently biased to extend beyond the side wall of the shroud.

Preferably wherein to move the shroud into the lower seated position finger pressure is used to urge the pins inwardly interior of the side wall of the shroud thereby allowing the shroud to slide-ably drop to the lower seated position.

Preferably wherein the shroud further includes a pole aperture for slide-ably receiving the pole there through thereby slide-ably guiding the shroud between the upper supported position and a lower seated position.

Preferably wherein the base includes a lower base and a circular upper base, the upper base having a diameter slightly smaller than an inner diameter of the shroud such that the shroud fits snugly over the upper base keeping the shroud in place in the lower seated position.

Preferably wherein the support platform includes a flange opening for receiving there through the pole flange which is dimensioned slightly smaller to fit through the flange opening when then pole is moved from the collapsed position to the raised assembled position.

Preferably wherein the flange opening is substantially the same shape as the pole flange which is dimensioned to just fit through the flange opening when then pole is moved from the collapsed position to the raised assembled position.

Preferably wherein the pole flange is rotated ninety degrees to rest on a top surface of the support platform thereby putting the pole in the assembled position.

Preferably wherein the pole flange and the flange opening are oval in shape.

Preferably wherein the pole flange and the flange opening are rectangular in shape.

DETAILED DESCRIPTION OF THE PREFERRED EMBODIMENTS

Figures 1, 2, 3:
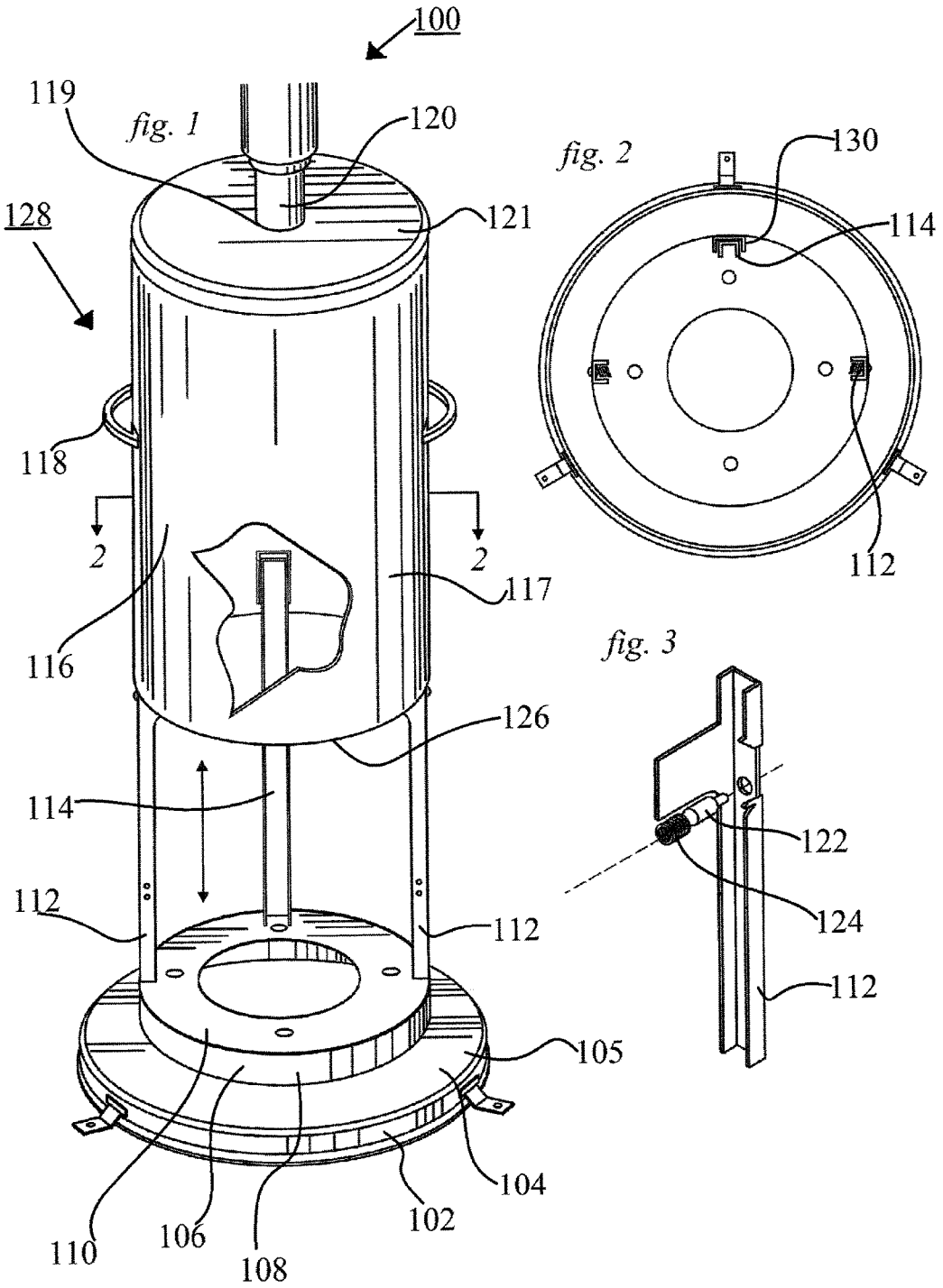
FIG. 1 is schematic partial perspective view of the base assembly of a patio heater.
FIG. 2 is a cross sectional view of the patio heater base assembly, taken along lines 2-2.
FIG. 3 is a partial schematic perspective view of the spring and pin assembly on the forward uprights.

Referring first of all to FIGS. 1 through 3 which depict the base assembly 100 of the present concept.

Base assembly 100 includes a lower base 102 having a lower horizontal surface 104 and a circular upper base 106 having an upper vertical surface 108 and an upper horizontal surface 110.

Base assembly further includes forward uprights 112 and a rear upright 114.

A shroud 116 is slide-ably received over the uprights in a vertical fashion using handles 118 in order to slide shroud 116 along the vertical uprights and along pole 120. Shroud 116 is cylindrical, having a cylindrical side wall 117 and a top cover 121. Forward uprights 112 each include a locking pin and spring assembly which includes a pin 122 and a spring 124 which moves outwardly to support a bottom edge 126 of shroud 116 thereby supporting shroud 116 in an upper supported position 128 as shown in FIG. 1. Shroud 116 has a pole aperture 119 that receives the pole and guides shroud 116 between the upper supported position 128 and lower seated position 291 shown in FIG. 8. In the upper supported position 128 the outer most portion of pin 122 engages with the bottom edge 126 of shroud 116 as shown in the diagram.

By using finger pressure to depress pin 122 so it no longer projects beyond bottom edge 126 thereby allowing shroud 116 to slideably move downwardly onto lower base 102 until bottom edge 126 comes to rest on the lower horizontal surface 104 and is also abutting against upper vertical surface 108 thereby keeping the lower portion of shroud 116 firmly in place.

Shroud 116 further includes a U-shaped guide bracket 130 which moves slideably along rear upright 114 as shroud 116 is manually lifted slideably along the uprights and pole 120 thereby preventing rotation of shroud 116.

Figure 4:
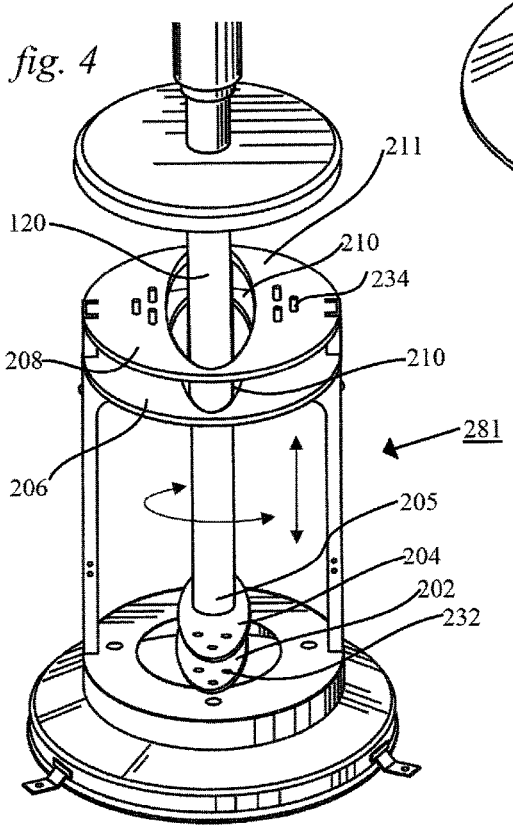
FIG. 4 is a schematic perspective view of the base and pole assembly without the shroud in place.

Referring now to FIG. 4 which shows the pole assembly 200 a patio heater normally includes a fairly lengthy pole 120 which in this case can be collapsed into a collapsed position 281 in which pole 120 is retracted into the base assembly 100 until the bottom pole flange 202 makes contact with lower base 102. The unit is normally shipped in the collapsed position 281.

Pole 120 includes a lower pole flange 202 at the bottom end 205 of the pole and an upper pole flange 204 which corresponds to a lower support platform 206 and an upper support platform 208.

Figure 5:
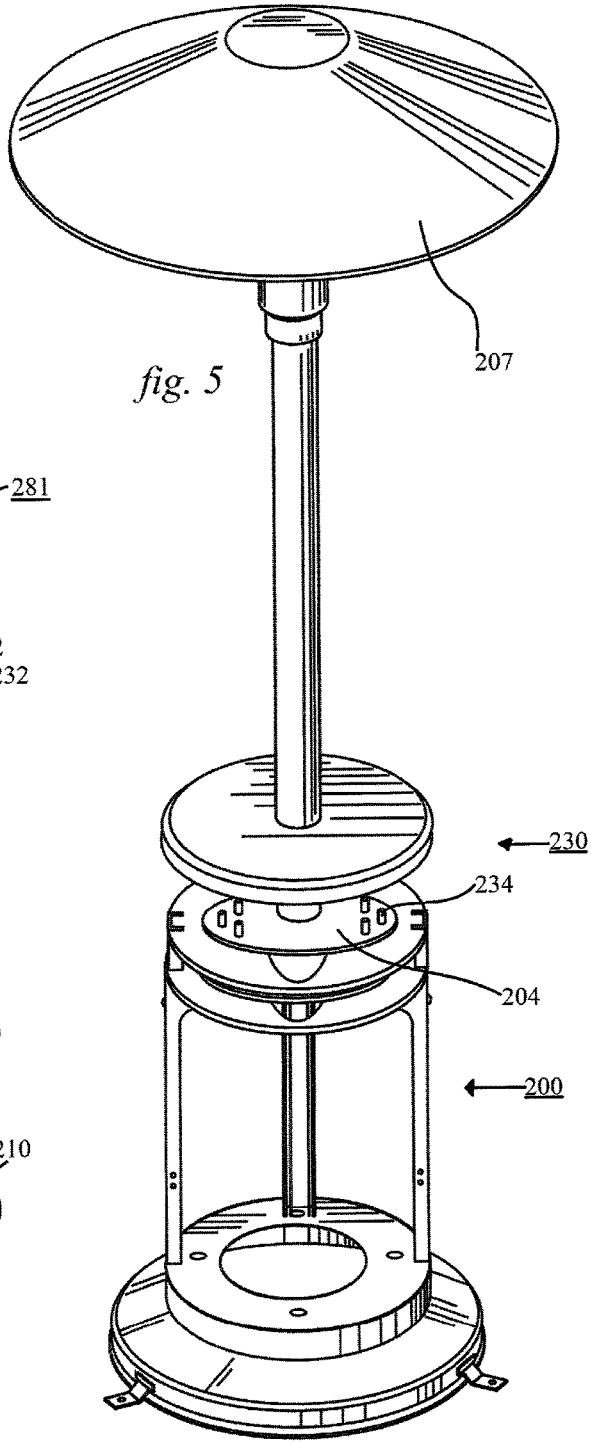
FIG. 5 is a schematic perspective view of the base and pole assembly without the shroud in place in an assembled position.
Figure 6:
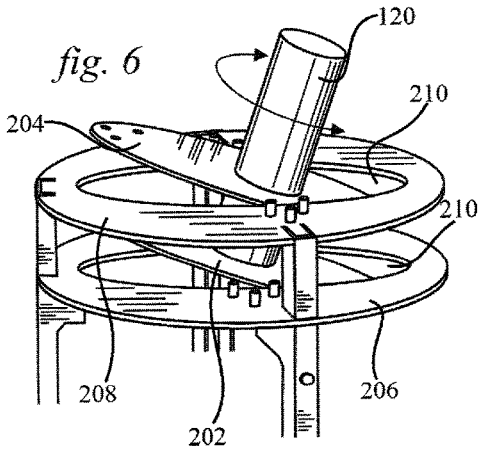
FIG. 6 is a schematic partial perspective view of a portion of the base and pole assembly.

Pole flanges 202 and 204 are dimensioned to fit through oval flange openings 210 as shown in FIG. 5 in order to move the pole assembly 200 from a shipping position to an assembled position 230 as shown in FIG. 5.

As pole 120 is lifted each of the pole flanges 202 and 204 pass through the oval flange openings 210 until such time as the lower pole flange 202 and the upper pole flange 204 can be rested on the lower support platform 206 and top surface 211 of upper support platform 208 respectively as shown in FIG. 5.

Figures 7, 8:
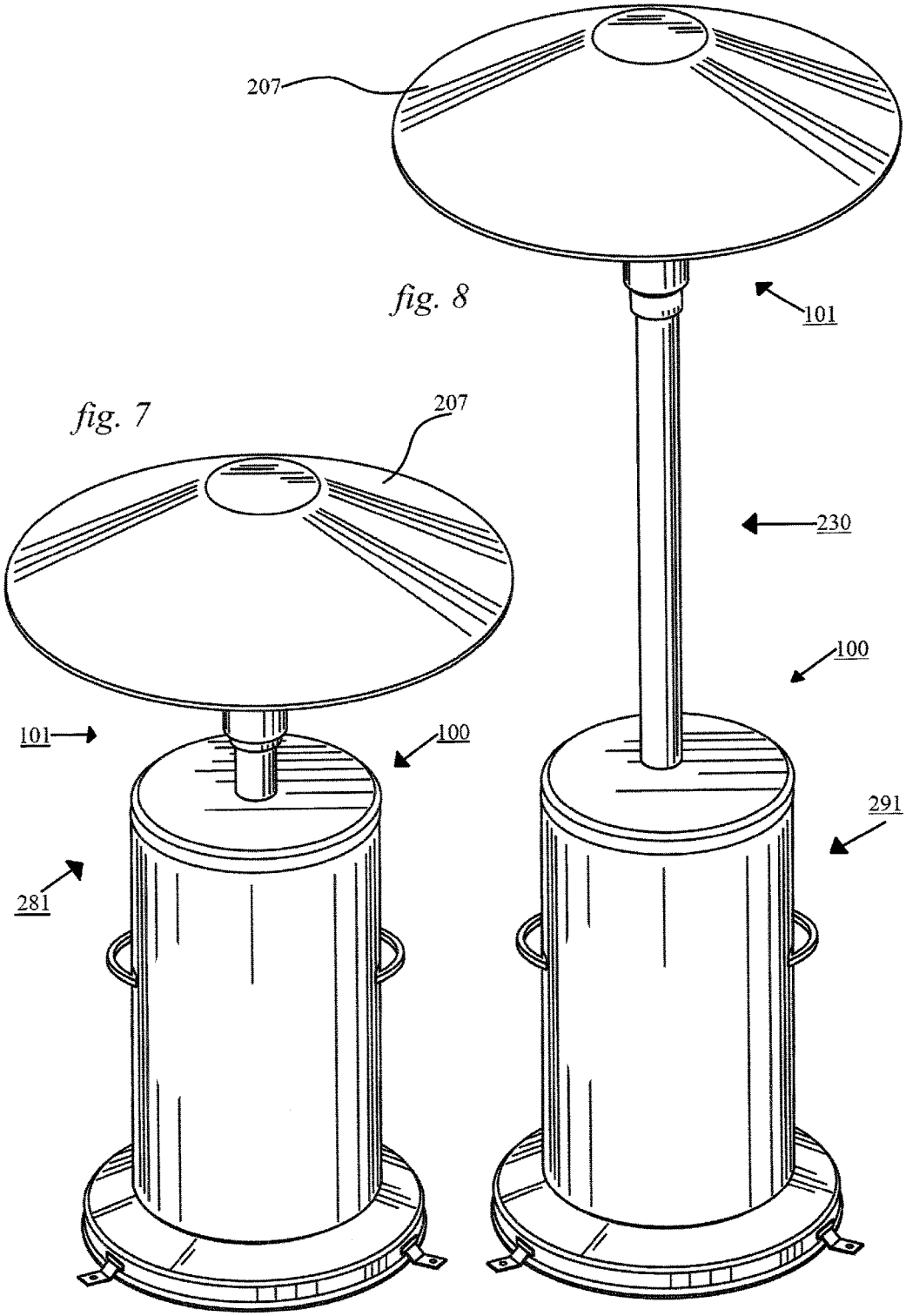
FIG. 7 is a schematic perspective view of the pole in the collapsed position.
FIG. 8 is a schematic perspective view of the base pole in the assembled position.

FIG. 7 shows base assembly and pole assembly in a collapsed position 281. FIG. 8 shows base assembly 100 and pole assembly 181 in an assembled position 230. FIGS. 7 and 8 depict the burner assembly 101 with reflector 207.

By twisting pole 120 until such time as the flange apertures 232 register with locking studs 234 thereby putting pole assembly 200 into the assembled position 230. Nuts and or other fasteners can be used to permanently attach and maintain the pole in the assembled position 230 as shown in FIG. 5.

It should be apparent to persons skilled in the arts that various modifications and adaptation of this structure described above are possible without departure from the spirit of the invention the scope of which defined in the appended claim.

I claim:

1. A patio heater assembly comprises:

a) a base and at least one support platform spaced from the base and supported and attached to a vertically extending rear upright and at least one vertically extending forward upright, the uprights attached at one end to the base and the other end to the at least one support platform;

b) a pole moveable between a collapsed position and a raised assembled position, c) the pole includes at least one pole flange at a bottom end of the pole, the pole flange for rigidly connecting to the support platform when in the raised assembled position, thereby maintaining the patio heater assembly in the raised assembled position, wherein in the collapsed position the pole flange rests on the base; and d) a shroud-slide-ably engaging over the uprights and slide ably moveable between an upper supported position above the base and a lower seated position.

2. The patio heater assembly claimed in claim 1 wherein the shroud includes a guide bracket for slide-ably engaging along the rear upright when the shroud is moved between a lower seated position and the upper supported position.

3. The patio heater assembly claimed in claim 2 wherein the guide bracket is a U shaped bracket such that the rear upright nests within the U of the guide bracket.

4. The patio heater assembly claimed in claim 3 wherein the rear upright is a U shaped channel dimensioned to nest with the U shaped bracket.

5. The patio heater assembly claimed in claim 1 wherein the shroud is cylindrical having a cylindrical side wall and a horizontal top cover such that in the lower seated position the shroud rests on the base and conceals the at least one support platform.

6. The patio heater assembly claimed in claim 5 wherein in the upper supported position the shroud is resting on pins resiliently biased to extend beyond the side wall of the shroud.

7. The patio heater assembly claimed in claim 6 wherein to move the shroud into the lower seated position finger pressure is used to urge the pins inwardly interior of the side wall of the shroud thereby allowing the shroud to slide-ably drop to the lower seated position.

8. The patio heater assembly claimed in claim 1 wherein the shroud further includes a pole aperture for slide-ably receiving the pole there through thereby slide-ably guiding the shroud between the upper supported position and a lower seated position.

9. The patio heater assembly claimed in claim 5 wherein the base includes a lower base and a circular upper base, the upper base having a diameter slightly smaller than an inner diameter of the shroud such that the shroud fits snugly over the keeping the shroud in place in the lower seated position.

10. The patio heater assembly claimed in claim 1 wherein the support platform includes a flange opening for receiving there through the pole flange which is dimensioned slightly smaller to fit through the flange opening when then pole is moved from the collapsed position to the raised assembled position.

11. The patio heater assembly claimed in claim 10 wherein the flange opening is substantially the same shape as the pole flange which is dimensioned to just fit through the flange opening when then pole is moved from the collapsed position to the raised assembled position.

12. The patio heater assembly claimed in claim 11 wherein the pole flange is rotated ninety degrees to rest on a top surface of the support platform thereby putting the pole in the assembled position.

13. The patio heater assembly claimed in claim 11 wherein the pole flange and the flange opening are oval in shape.

14. The patio heater assembly claimed in claim 11 wherein the pole flange and the flange opening are rectangular in shape.

* * * * *